United States Patent [19]

Ursenbach

[11] Patent Number: 4,780,725

[45] Date of Patent: Oct. 25, 1988

[54] ROTARY CURTAIN ANTENNA

[75] Inventor: François Ursenbach, Eaubonne, France

[73] Assignee: Thomson-CSF, Paris, France

[21] Appl. No.: 14,715

[22] Filed: Feb. 13, 1987

[30] Foreign Application Priority Data

Feb. 18, 1986 [FR] France ..... 86 02184

[51] Int. Cl.[4] ..... H01Q 21/12

[52] U.S. Cl. ..... 343/815; 343/816; 343/822; 343/882

[58] Field of Search ..... 343/812, 814, 815, 816, 343/820, 821, 822, 879, 882, 757

[56] References Cited

U.S. PATENT DOCUMENTS

| | | | |
|---|---|---|---|
| 2,268,640 | 1/1942 | Brown | 343/822 |
| 2,409,944 | 10/1946 | Loughren | 343/815 |
| 2,642,528 | 6/1953 | Albright | 343/822 |
| 2,938,209 | 5/1960 | Brueckmann | 343/814 |

FOREIGN PATENT DOCUMENTS

| | | | |
|---|---|---|---|
| 188759 | 2/1957 | Austria | 343/879 |
| 729912 | 10/1940 | Fed. Rep. of Germany | 343/814 |
| 1000880 | 1/1957 | Fed. Rep. of Germany | 343/822 |
| 0100603 | 6/1984 | Japan | 343/757 |
| 94427 | 2/1939 | Sweden | 343/812 |

OTHER PUBLICATIONS

DE-A-23 37 997, (Licentia), *pp. 4, 5, 7, paragraphe 3; p. 8; Revendications 1-12*.

DE-C-1 000 880, (Telefunken), *Colonne 1, Lignes 27-40; Colonne 4, Ligne 39-Colonne 5, Ligne 17; Colonne 6, Lignes 14-21*.

The Sert Journal, vol. 8, Sep. 1974, pp. 183, 184, Londres, GB; M. J. Underhill et al.: "Automatic Tuning of Anten-ae", *En Entier*.

DE-A-26 57441, (Rohde & Schwarz), *Revendications 1-4 et al Figure*, Telecommunications, vol. 24, No. 3, Mars 1970, pp. 41-43; V. D. Kuznetsov et al.

¢A High-Power Balancing-Matching Transformer ofr the 3-30 MHzband", *En Entier*.

DE-A-28 55623, (Licentia), *p. 9, Lignes 2-31*.

*Primary Examiner*—William L. Sikes

*Assistant Examiner*—Hoanganth Le

*Attorney, Agent, or Firm*—Cushman, Darby & Cushman

[57] ABSTRACT

So as to allow modification of the radiation diagram of a rotary curtain antenna, the doublets of a curtain are distributed in groups of one or several doublets and each group has its own feed line which connects it to a switching box situated in the mast of the antenna and which is constructed so as to bring to the box an impedance inversely proportional to the number of doublets fed by this line; this box allows all or part of the groups of doublets to be fed at will from a mast down line. Dynamic impedance matching cells disposed at the foot of the antenna provide a small standing wave ratio for connection with a transmitter.

3 Claims, 2 Drawing Sheets

ROTARY CURTAIN ANTENNA

BACKGROUND OF THE INVENTION

The present invention relates to curtain antennae including a rotary support supporting at least one vertical curtain of doublets and a reflecting part. This reflecting part is made of wires and is disposed behind the curtain or curtains, that is to say, in the case of two curtains, between the curtains.

Such antennae are known and are used for example for decametric wave operation; they very often have only a single supply line which generally passes through the support and, in the case of two curtains, supplies one or other of the two curtains through a switching device.

The azimuth aiming angle of these known antennae is readily adjustable, in any direction, by rotating the mast. On the other hand, these antennae are not adjustable in elevation for known solutions modifying the elevational angle of a fixed curtain antenna are practically unusable in rotary antennae. In fact, they would require feeding the full wave doublets of a curtain in groups of doublets, using as many lines as there are groups, so as to be able to disconnect the part of the doublets of the curtain through switching, matching, and symmetrization assemblies placed at the foot of the antenna. Now, it is already difficult to form a single feed line capable of rotating by + and −180° from a rest position and the problem becomes impossible to solve if it is a question of several lines to be rotated through 180°, without forgetting that in addition a low standing wave ratio must be obtained at the input of the antenna.

SUMMARY OF THE INVENTION

The purpose of the present invention is to provide a rotary antenna with variable radiation diagram.

This is obtained, in particular, by disposing in the support and substantially at mid height of the curtain, a device for connecting all or part of the doublets of the curtain and by combining the characteristics of the other means used in the antenna, such as feed line and impedance matcher, so as to obtain a standing wave ratio close to 1.

According to the present invention there is provided a rotary curtain antenna including: a rotary support; at least one curtain of doublets, the doublets of the curtain being distributed in n (n an integer at least equal to 2) groups of at least one doublet; a switching device fixed to the support and intended to connect from 0 to n of the n groups; n feed lines for respectively connecting the n groups to the switching device, the impedances brought by each of the n lines to the device being chosen inversely proportional to the number of doublets of the group fed by the line considered; a down line whose characteristic impedance is substantially the average of the maximum and minimum impedances brought to the device when the device connects from 1 to n groups; and a dynamic impedance matching device coupled to the switching device by the down line.

BRIEF DESCRIPTION OF THE DRAWINGS

The present invention will be better understood and other characteristics will appear from the following description and accompanying Figures which show.

In the different Figures, the corresponding elements are designated by the same references.

MORE DETAILED DESCRIPTION

Figure 1:
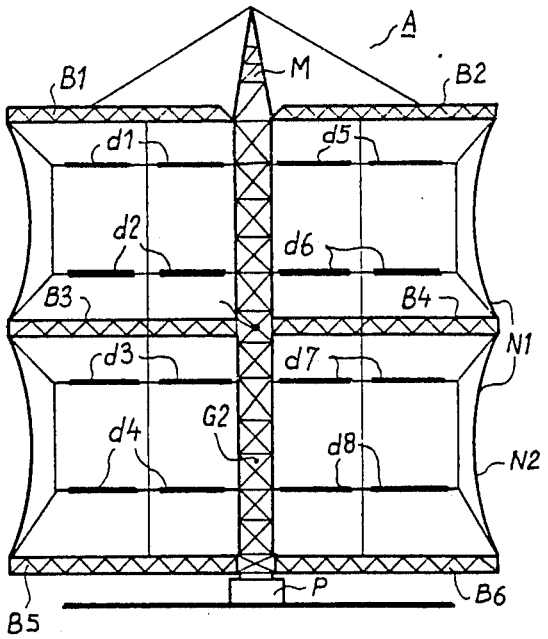
FIG. 1 to 3, three schematical views of an antenna in accordance with the invention, FIG. 4, an electric diagram of part of the feed for the antenna of FIGS. 1 to 3, FIG. 5, a variant of construction of one of the elements of FIG. 5.
Figure 2:
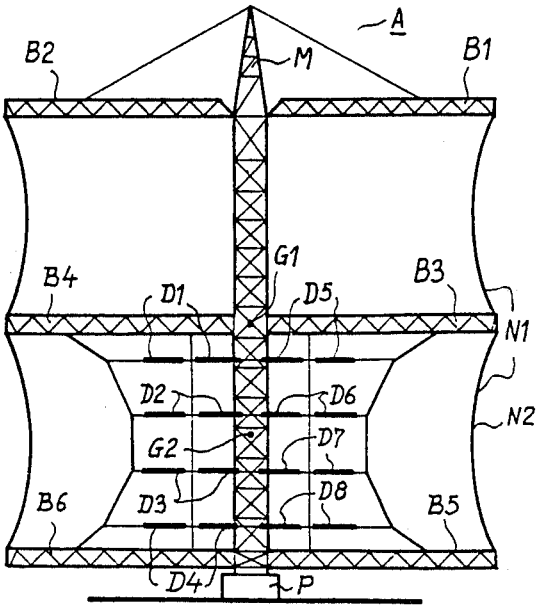
Figure 3:
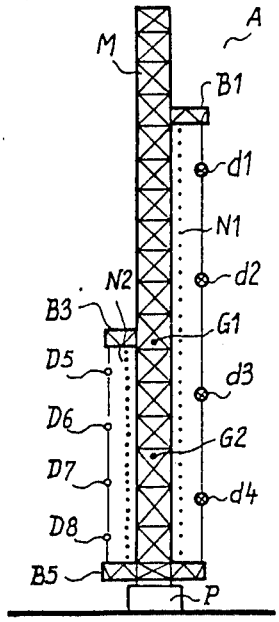

FIGS. 1 to 3 show respectively the two faces and one of the sides of a double rotary antenna, A, made from two curtains of full wave doublets, d1 to d8 and D1 to D8.

This antenna includes a foot P which supports a mast M integral with three pairs of horizontal arms B1-B2, B3-B4,B5-B6. The two curtains d1 to d8 and D1 to D8 are disposed in parallel vertical planes and are fixed to the arms by means of insulators and cables; since the method of fixing these curtains is conventional and has no importance for understanding the invention, it will not be described in greater detail in what follows. The antenna also includes two reflecting screens, N1, N2, made from horizontal metal wires disposed in a vertical plane; in FIGS. 1 and 2 only the cables which stretch these wires have been shown; in FIG. 3, the wires are shown in section, very much enlarged and less numerous than they are in actual fact, so that they are made visible in this Figure.

The double antenna A, of an overall height of 85 meters and a spread of 76 meters, includes two antennae properly speaking: one antenna of the type HR 4/4/0.5 for the visible face 1 (that is to say of the horizontal doublet curtain type, H. with reflector, R, having two full wave doublets per line and per column, namely the equivalent of four half wave doublets per line and per column, and having a height of the first doublets with respect to the ground equal to 0.5 times the mean operating wave length (and is of the type HR 4/4/1 for the visible face in FIG. 2. The antenna visible in FIG. 1 forms what will be called, in what follows, a low frequency antenna and is intended to work in the 6, 7, 9 and 11 megahertz bands. The antenna visible in FIG. 2 forms what will be called, in what follows, a high frequency antenna and is intended to work in the 13, 15, 17, 21 and 26 megahertz bands.

Figure 4:
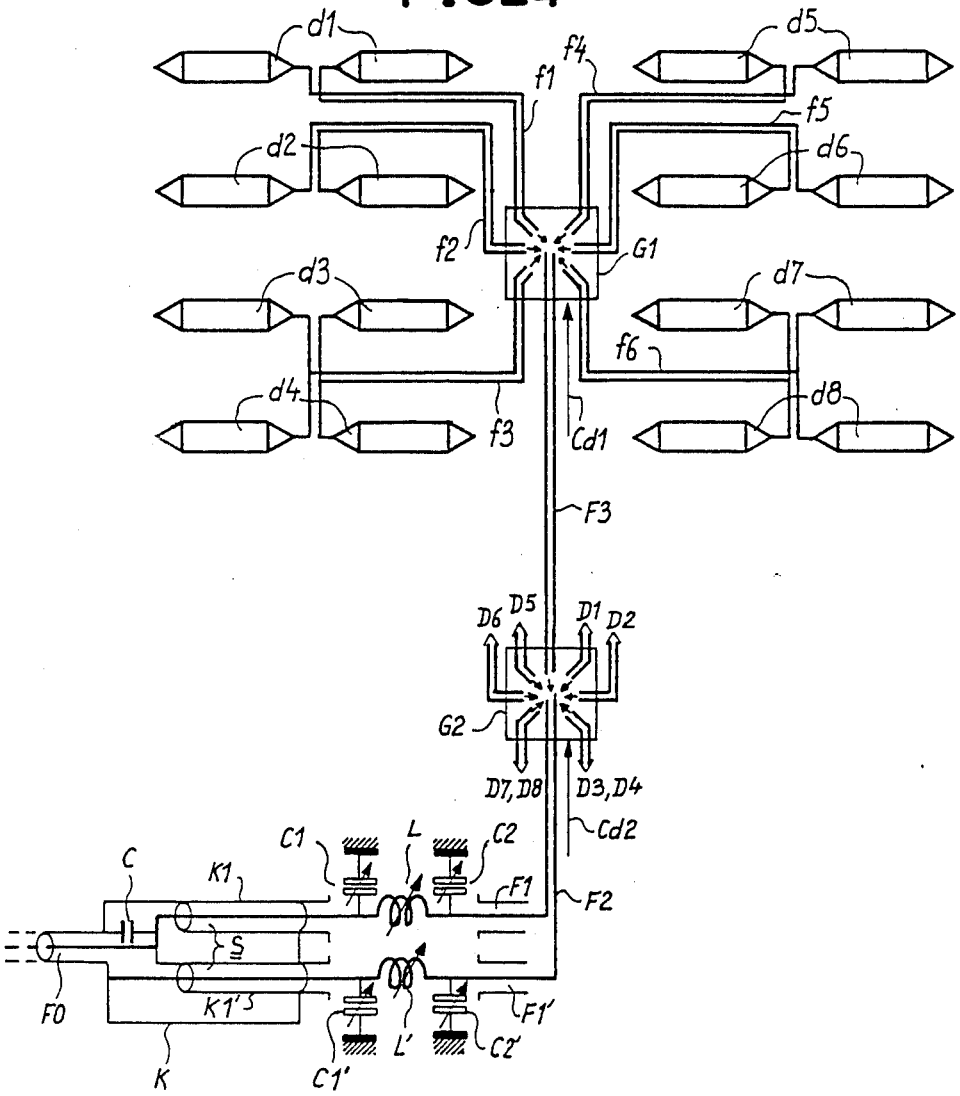

FIG. 4 shows how the feed for the double antenna A, of FIGS. 1 to 2 is formed from a coaxial feed line FO arriving at the foot of the antenna. To simplify the explanations the description of this feed will be made by beginning at the level of the doublets d1 to d8 of the low frequency antenna.

The eight full wave doublets d1 to d8 have a nominal impedance of 480 ohms and an SWR equal to 2 (SWR: standing wave ratio). The eight full wave doublets form two groups of two full wave doublets d8+d4 and d7+d8 and four groups of one full wave doublet d1, d2, d5 and d6. The groups are fed in parallel and in phase, by six symmetrical feed lines, f1 to f6; these lines, all of the same length, extend from a switching box G1 placed inside the mast M, at mid height of the low frequency antenna; in FIGS. 1 to 3, the position of this box as well as that of box G2 which, as will be seen further on, is relative to the high frequency antennae have been shown. For each group of full wave doublets, the feed line is constructed so as to bring to box G1 an impedance inversely proportional to the number of doublets fed by this line; thus, for the groups of two full wave doublets d3+d4 and d7+d8, the impedance brought is 240 ohms with an SWR of 2 whereas for the groups of a single full wave doublet d1, d2, d5 and d6, the impedance brought is 480 ohms with an SWR of 2.

In the use which is made of the antenna, it is provided either a group of two full wave doublets, or a group of two doublets and the group of one doublet immediately above, or all the groups of the same vertical half of the antenna, or the two groups of two doublets, or the two groups of two doublets and the two groups of one doublet immediately above, or all the doublets of the antenna. Thus, it is clear that the total impedance brought to box G1 is at least 60 ohms (all the groups being fed) with an SWR of 2, and at most to 240 ohms (a single group of two full wave doublets being fed) still with an SWR of 2.

The switching box G1 has been shown symbolically by a block in which arrives, from the bottom, a symmetrical line F3 for feeding the low frequency antenna and from which extend the six symmetrical lines F1 to F6 for feeding the six groups; six arrows symbolize in this block the six double contact mechanism providing the possible switching operations under the control of switching signals delivered by a cable Cd1. It should be noted that the passage of cable Cd1 through the mast of the antenna raises no problem for, since the energy required for controlling the mechanisms of box G1 is small, the cable Cd1 is a flexible multiwire cable which may readily twist when the antenna rotates through 360°. It is recalled in this connection that with rotary curtain antennae provision is not generally made to rotate through more than 360°, that is to say that the antenna does not pass twice in the same direction through the same position; this is the case of the double antenna which served as example in the present description.

The symmetrical line F3 is connected to the switching box G2. Box G2, which is relative to the high frequency antenna, is only distinguished from box G1 by the presence of an additional mechanism and output for feeding, when the mechanism is actuated, the low frequency antenna and, in the opposite case, the high frequency antenna; since the connections between the doublets of the high frequency antenna and box G2 are identical to those between the doublets of the low frequency antenna and box G1 and since these antennae are used in an identical way, a more ample description of the high frequency antenna will not be given in what follows.

When the low frequency antenna is in use, box G2 ensures only the connection between the access corresponding to the symmetrical line F3 and the common access corresponding to a symmetrical line F2 coming from the foot of the mast of the antenna; line F2 is designed so as to twist by + and −180° over its length without mechanical disadvantages and without modifying its electrical characteristics.

The symmetrical feed lines F2 and F3 are 120 ohm lines, operating with an SWR at most equal to 4 since, as was mentioned above, the minimum impedance brought to the box may range from 60 to 240 ohms with an SWR of 2; the value of 120 ohms for lines F2 and F3 has been chosen as corresponding substantially to the average between the minimum and maximum impedances brought to box G1.

Arriving at the ground, the two conductors of the symmetrical line F2 are treated separately as two conductors F1, F1', each of 60 ohms operating with an SWR of 4. Each of these two conductors is connected to a dynamic impedance matching cell, of conventional type, formed by an adjustable series inductance L1 and L1', surrounded by two adjustable capacitors C1, C2 and C1', C2', shunted to ground. The value of the inductances and of the capacitors is controlled, as a function of the antenna configuration chosen, by a control assembly, not shown, which keeps in memory the adjustments of the elements of these cells.

These impedance matching cells provide matching between an impedance of 60 ohms with an SWR of 4 on the access receiving the line F1 of F1'and an impedance of 100 ohms with an SWR of the order of 1 to 1.3 on the opposite access.

The two impedance matching cells are followed by a symmetrizing circuit S, also of conventional type, including an input over two coaxial lines K1, K1' with a characteristic impedance of 100 ohms associated with a capacitor C and a coaxial line FO with a characteristic impedance of 50 ohms, which thus has an SWR between 1 and 1.3.

The symmetrizer S is formed from a sort of metal box K into which lines K1 and K1' penetrate on one side and from which leaves the line FO. In box K, the outer conductor of the cable K1 is in contact, over the whole of its length, with the wall of K whereas the outer conductor of K1' is only in contact with the hole at the level of the penetration hole, as is also the outer conductor of line FO. Inside box K, the inner conductor of line K1 is connected to the outer conductor of the line K1', at the end of K1' opposite the impedance matching circuit C1'-L'C2'; the inner conductor of line K1 is also connected, in a box K, to the inner conductor of the line FO and, through the capacitor C, to a point of the junction between the outer conductor of line FO and box K; the inner conductor of line K1', as for it, is connected to the wall of box K in the vicinity of the junction of this wall with the outer conductor of line FO.

Figure 5:
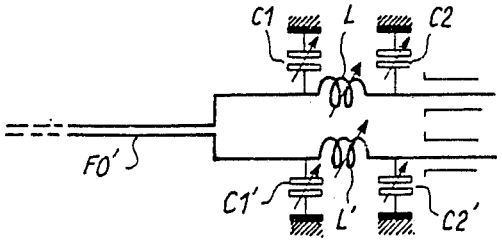

The embodiment described with reference to FIG. 4 is intended for connecting a transmitter situated in the vicinity of the symmetrizer circuit S, that is to say inside or in the immediate vicinity of the foot of the antenna mast. For a transmitter further away from the antenna, the high cost of the coaxial line FO, because of the powers which it must transmit, means that an installation is to be preferred, in accordance with FIG. 5, where the symmetrizer S is suppressed at least on the antenna side; in this case, the two impedance matching cells are designed for presenting, from a 60 ohm access with SWR of 4 on the antenna side, an access of 100 or 150 ohms with an SWR of 1 to 1.3. The connection with a transmitter is made by means of a symmetrical 200 or 300 ohm line FO' connected directly to the 100 or 150 ohm accesses of the two matching cells; a symmetrizer not shown, which is similar to that of FIG. 4 is interposed in this symmetrical line and the transmitter.

It should be noted that the transmitter associated with the antenna of FIG. 4 includes an impedance matching circuit which could then be suppressed, the impedance matching cell shown in FIG. 4 alone providing the impedance matching; in the device which has served as example for the above description nothing of the kind is possible for the matching cells shown in FIG. 4 serve, as was mentioned above, for providing a predetermined adjustment as a function of the chosen antenna figuration, whilst it is provided that the impedance matching circuit associated with the transmitter allows fine impedance matching adjustment.

The present invention is not limited to the example described and, in particular, applies to the cases where the feed is provided not by means of fullwave doublets but by half wave doublets, that is to say with twice the number of lines such as fl to f6 than in the example described; it also applies to the cases where the number of doublets per curtain is different from 8 but is at least equal to 2 so as to be able to define two groups of different doublets; it also applies to the case where the rotary antenna is a simple and not a double antenna, that is to say has only a single curtain of doublets and even to the case where the rotary antenna has three curtains and more distributed, for example, in the case of three curtains about a support having a horizontal section in the form of an equilateral triangle, each side of which is assigned to a curtain.

What is claimed is:

1. A rotary curtain antenna including:

a rotary support;

at least one curtain of doublets, the doublets of the curtain being distributed in n (n an integer at least equal to 2) groups of at least one doublet;

a switching device fixed to the support for interconnecting from 0 to n of the n groups:

n feed lines for respectively connecting the n groups to the switching device, the impedances brought by each of the n lines to the device being inversely proportional to the number of doublets of the group fed by said each line;

a down line whose characteristic impedance is substantially the average of the maximum and minimum impedances brought to the device when the device connects from 1 to n groups; and a dynamic impedance matching device coupled to the switching device by the down line.

2. The antenna as claimed in claim 1, including in series: a coaxial line, a symmetrizer device, said matching device and said down line.

3. The antenna as claimed in claim 1 comprising in series: a symmetrical line, said matching device and said down line.

* * * * *